US011930911B1

(12) United States Patent
Windsor

(10) Patent No.: US 11,930,911 B1
(45) Date of Patent: Mar. 19, 2024

(54) HAIR GROOMING DEVICE AND ASSOCIATED USE THEREFORE

(71) Applicant: Tara O'Connor Windsor, Oak Forest, IL (US)

(72) Inventor: Tara O'Connor Windsor, Oak Forest, IL (US)

( * ) Notice: Subject to any disclaimer, the term of this patent is extended or adjusted under 35 U.S.C. 154(b) by 477 days.

(21) Appl. No.: 17/336,143

(22) Filed: Jun. 1, 2021

Related U.S. Application Data

(63) Continuation-in-part of application No. 16/201,673, filed on Nov. 27, 2018, now Pat. No. 11,044,983.

(60) Provisional application No. 62/590,688, filed on Nov. 27, 2017.

(51) Int. Cl.
*A45D 44/16* (2006.01)

(52) U.S. Cl.
CPC ..... *A45D 44/16* (2013.01)

(58) Field of Classification Search
CPC ..... A45D 44/16; A47K 7/024; A47K 7/026; A47K 7/03
See application file for complete search history.

(56) References Cited

U.S. PATENT DOCUMENTS

| | | | | | |
|---|---|---|---|---|---|
| 1,303,500 | A * | 5/1919 | Rosenberg | A47L 11/4038 | 15/247 |
| 2,935,755 | A * | 5/1960 | Leira | A46B 7/06 | 15/186 |
| 3,577,580 | A * | 5/1971 | Rand | A46B 17/06 | 15/169 |
| 4,517,703 | A * | 5/1985 | Koke | A46D 1/0284 | 15/187 |
| 5,293,660 | A * | 3/1994 | Park | A46B 5/06 | 428/101 |
| 8,302,246 | B2 * | 11/2012 | Chudzik | A46B 7/00 | 132/120 |
| 11,445,804 | B1 * | 9/2022 | Heacock | A46B 9/023 | |
| 2002/0138930 | A1 * | 10/2002 | Wheeler | A47K 7/026 | 4/606 |
| 2018/0064233 | A1 * | 3/2018 | Riley | A46B 17/02 | |

* cited by examiner

*Primary Examiner* — Randall E Chin
(74) *Attorney, Agent, or Firm* — Ashkan Najafi

(57) ABSTRACT

A hair grooming device includes a receptacle including a first half hingedly coupled to the second half, a base plate statically seated within the receptacle and including a plurality of bristles attached thereto, a top plate removably stacked on the base plate and seated in the receptacle, the top plate including a plurality of apertures, and a plurality of suction cups coupled to the first half of the receptacle. Advantageously, the bristles are aligned and positioned through the apertures when the top plate is positioned on the base plate. In this manner, the bristles terminate away from the top plate such that the top plate shields the base plate from the hair. Notably, the top plate is freely disengaged from the base plate and capable of both collecting and removing the hair from the receptacle.

19 Claims, 11 Drawing Sheets

HAIR GROOMING DEVICE AND ASSOCIATED USE THEREFORE

CROSS REFERENCE TO RELATED APPLICATIONS

This is a continuation-in-part application that claims the benefit of and priority to U.S. non-provisional patent application Ser. No. 16/201,673 filed Nov. 27, 2018, now U.S. Pat. No. 11,044,983, which claims the benefit of and priority to U.S. provisional patent application No. 62/590,688 filed Nov. 27, 2017, now abandoned, which are incorporated by reference herein in their entireties.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to hair grooming implements and, more particularly, to a specially designed hair grooming device including a receptacle for collecting, concealing, and storing hair that is left on one's hands after shampooing, until the user is ready to empty, thus avoiding messes in the bath, messes on the shower walls, and preventing the clogging of drains.

Prior Art

Imagine vigorously shampooing the hair when bathing; as many would attest, it is quite common for loose hair to come away in the hands. Unfortunately, this loose hair often ends up messily clinging to shower walls and floors or worse, clogging drains. The Hair grooming device 10 would eliminate these challenges by offering a secure place for collecting, managing, and disposing of this hair.

Accordingly, a need remains for an improved hair grooming device in order to overcome at least one of the above-noted shortcomings. The exemplary embodiment(s) satisfy such a need by a specially designed hair grooming device including a receptacle that is convenient and easy to use, lightweight yet durable in design, versatile in its applications, and designed for collecting, concealing, and storing hair that is left on one's hands after shampooing, until the user is ready to empty, thus avoiding messes in the bath, messes on the shower walls, and preventing the clogging of drains.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a hair grooming device for collecting, concealing, and storing hair that is left on a user hand after shampooing, until the user is ready to empty, thus avoiding messes in the bath, messes on the shower walls, and preventing the clogging of drains. These and other objects, features, and advantages of the non-limiting exemplary embodiment(s) are provided by a hair grooming device including a receptacle including a first half hingedly coupled to the second half, a base plate statically seated within the receptacle and including a plurality of bristles attached thereto, a top plate removably stacked on the base plate and seated in the receptacle, the top plate including a plurality of apertures, and a plurality of suction cups coupled to the first half of the receptacle. Advantageously, the bristles are aligned and positioned through the apertures when the top plate is positioned on the base plate. In this manner, the bristles terminate away from the top plate such that the top plate shields the base plate from the hair. Notably, the top plate is freely disengaged from the base plate and capable of both collecting and removing the hair from the receptacle.

In a non-limiting exemplary embodiment, the base plate has a planar top surface and a planar bottom surface, wherein the top plate has a planar top surface and a planar bottom surface.

In a non-limiting exemplary embodiment, the bristles include a first group of tall bristles and a second group of short bristles juxtaposed thereto.

In a non-limiting exemplary embodiment, the first group of tall bristles and the second group of short bristles are penetrated through the apertures, respectively, while the top plate is stacked on the base plate.

In a non-limiting exemplary embodiment, the top plate includes a proximal end having a flexible pull tab attached thereto.

In a non-limiting exemplary embodiment, the receptacle includes a handle extended along a latitudinal width of the first half of the receptacle.

In a non-limiting exemplary embodiment, the top plate is configured to be selectively removed from the first half of the receptacle when disengaged from the base plate.

In a non-limiting exemplary embodiment, the bottom surface of the top plate is registered parallel to the top surface of the base plate when stacked thereon.

In a non-limiting exemplary embodiment, the first group of tall bristles and the second group of short bristles are oriented perpendicular to the top surface of the base plate and the top surface of the top plate.

The present disclosure further includes a method of utilizing a hair grooming device for collecting, concealing, and storing hair that is left on a user hand after shampooing, until the user is ready to empty, thus avoiding messes in the bath, messes on the shower walls, and preventing the clogging of drains. Such a method including the steps of: providing a receptacle including a first half hingedly coupled to the second half; providing a base plate including a plurality of bristles attached thereto; statically seating the base plate within the receptacle; providing a top plate including a plurality of apertures; removably stacking the top plate on the base plate such that the top plate is seated in the receptacle; providing and coupling a plurality of suction cups to the first half of the receptacle; aligning and positioning the bristles through the apertures by positioning the top plate on the base plate; and the bristles terminating away from the top plate such that the top plate shields the base plate from the hair.

The method further includes the steps of: providing shampoo; washing a user hair with the shampoo; brushing the user hair with the bristles and thereby collecting the user hair on the top plate away from the base plate; and freely disengaging the top plate from the base plate and thereby removing the user hair from the receptacle.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
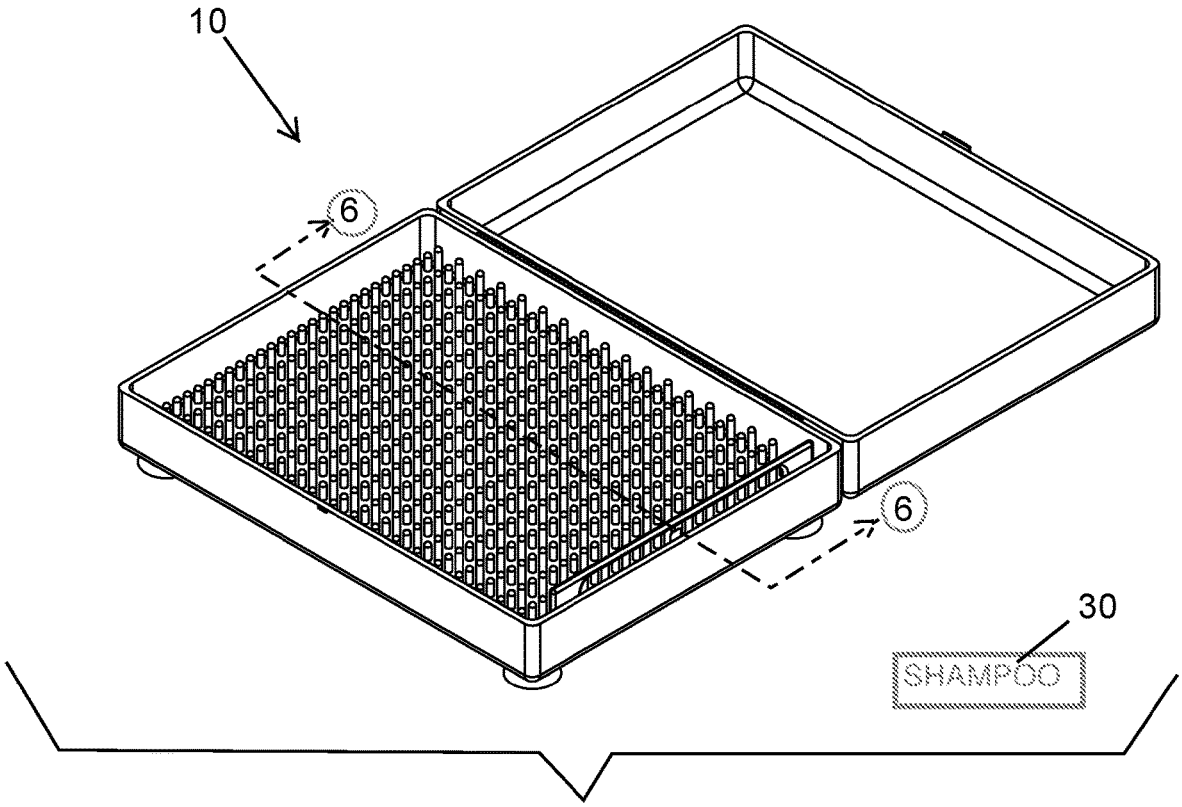
FIG. 1 is a perspective view of a hair grooming device and separate quantity of shampoo, in accordance with a non-limiting exemplary embodiment of the present disclosure.
Figure 2:
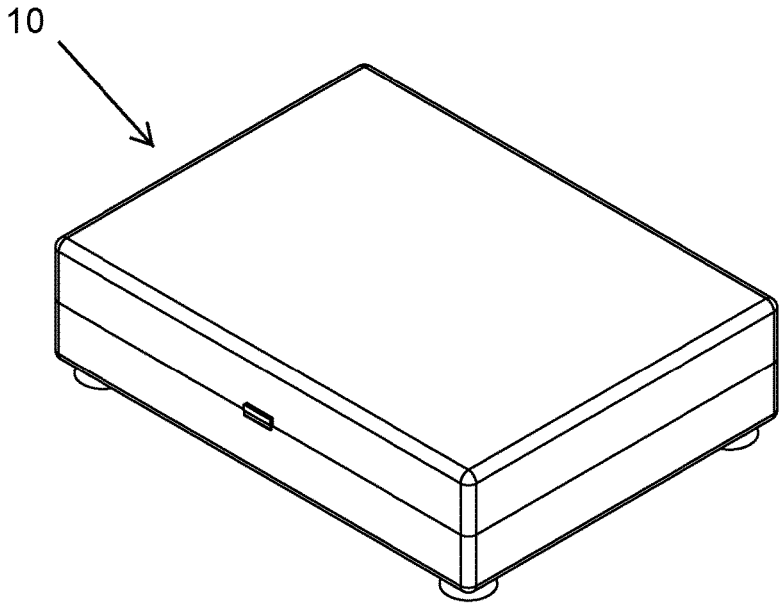
FIG. 2 is a perspective view of the hair grooming device at a closed position.
Figure 3:
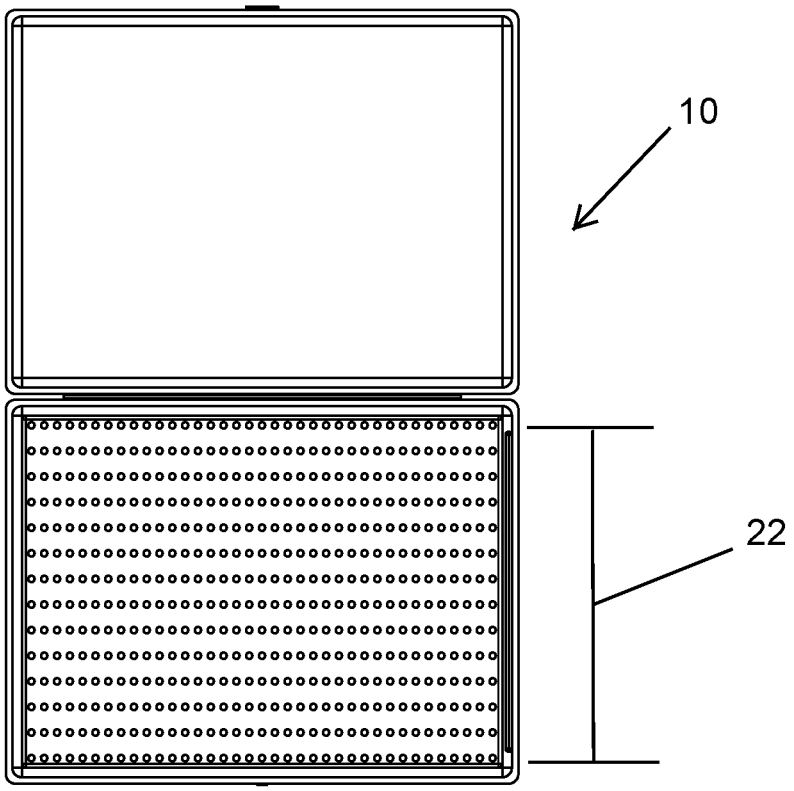
FIG. 3 is a top plan view of the hair grooming device shown in FIG. 1.
Figure 4:
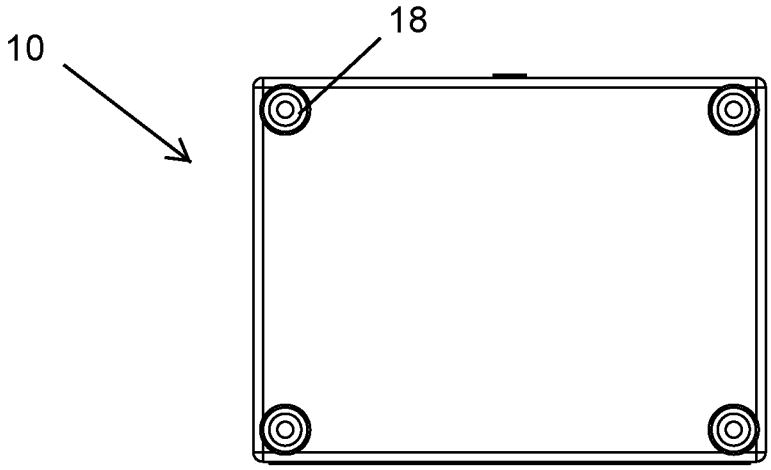
FIG. 4 is a bottom plan view of the hair grooming device shown in FIG. 2.
Figure 5:
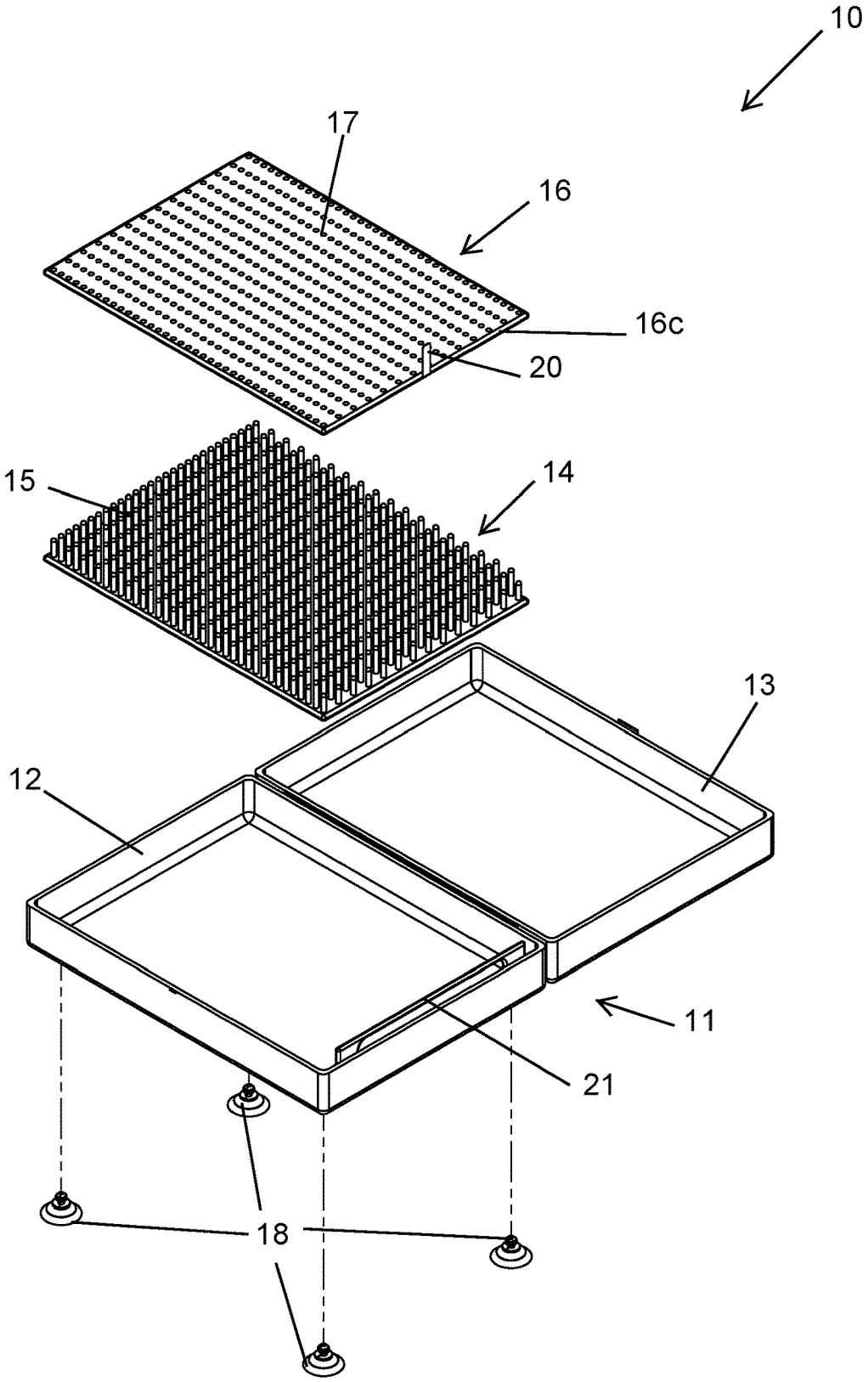
FIG. 5 is an exploded view of the hair grooming device.
Figure 6:
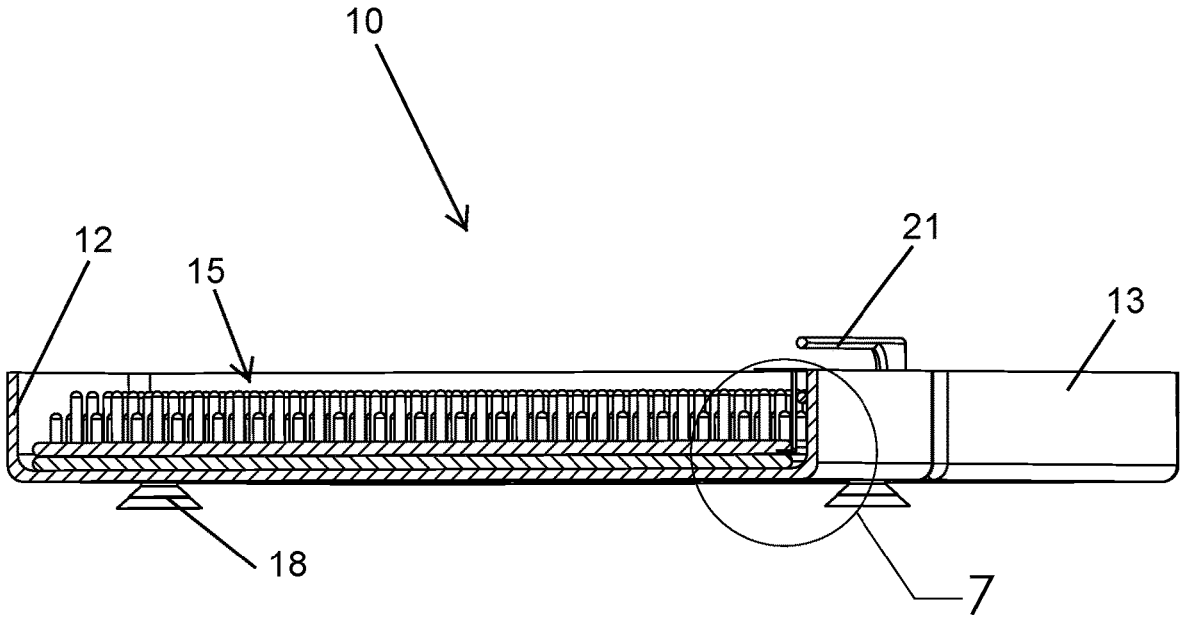
FIG. 6 is an enlarged cross-sectional view taken along line 6-6 in FIG. 1.
Figure 7:
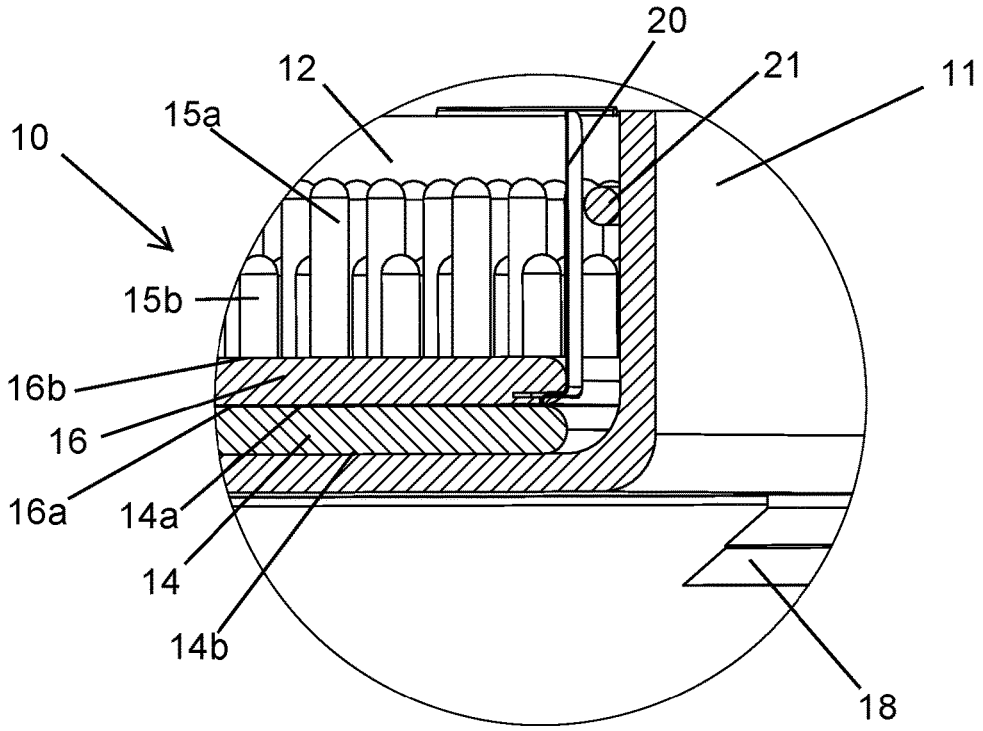
FIG. 7 is an enlarged view take at section 7 in FIG. 6.
Figure 8:
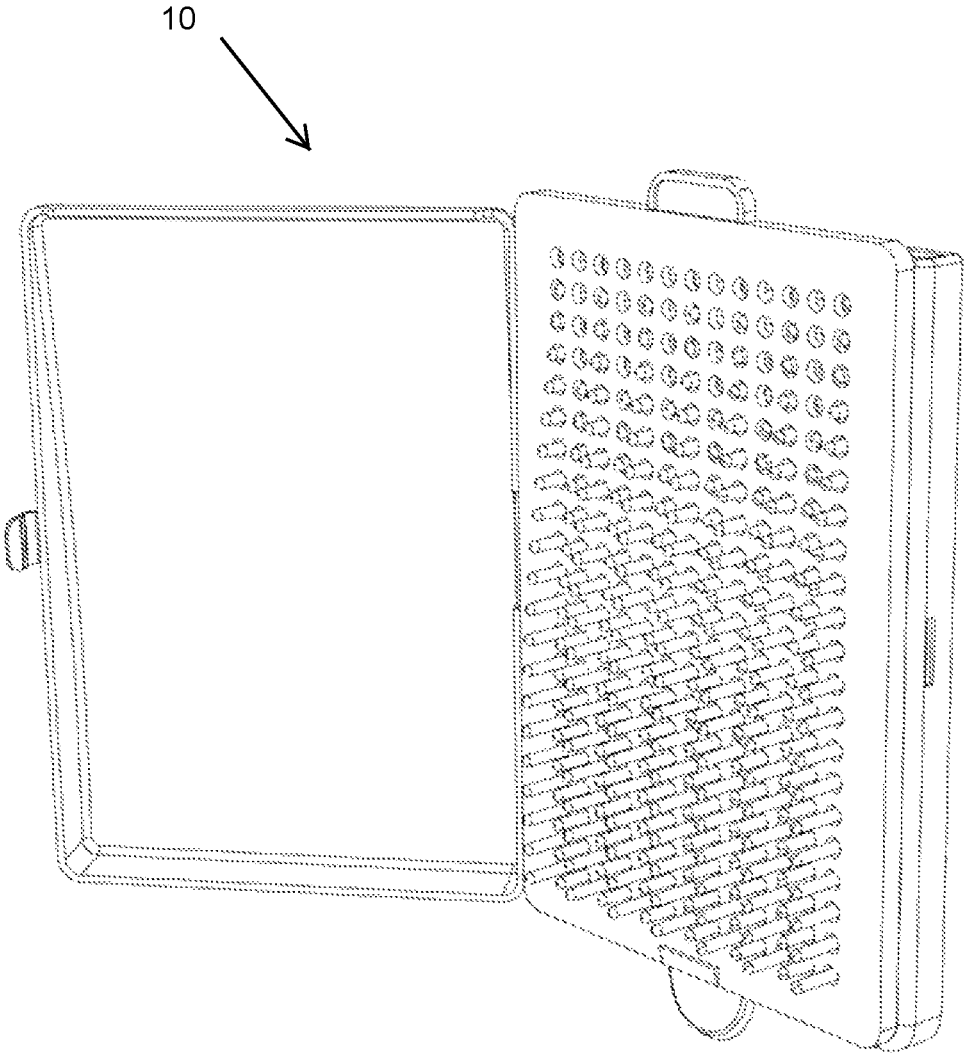
FIG. 8 is a perspective view of the hair grooming device, in accordance with a non-limiting exemplary embodiment of the present disclosure.
Figure 9:
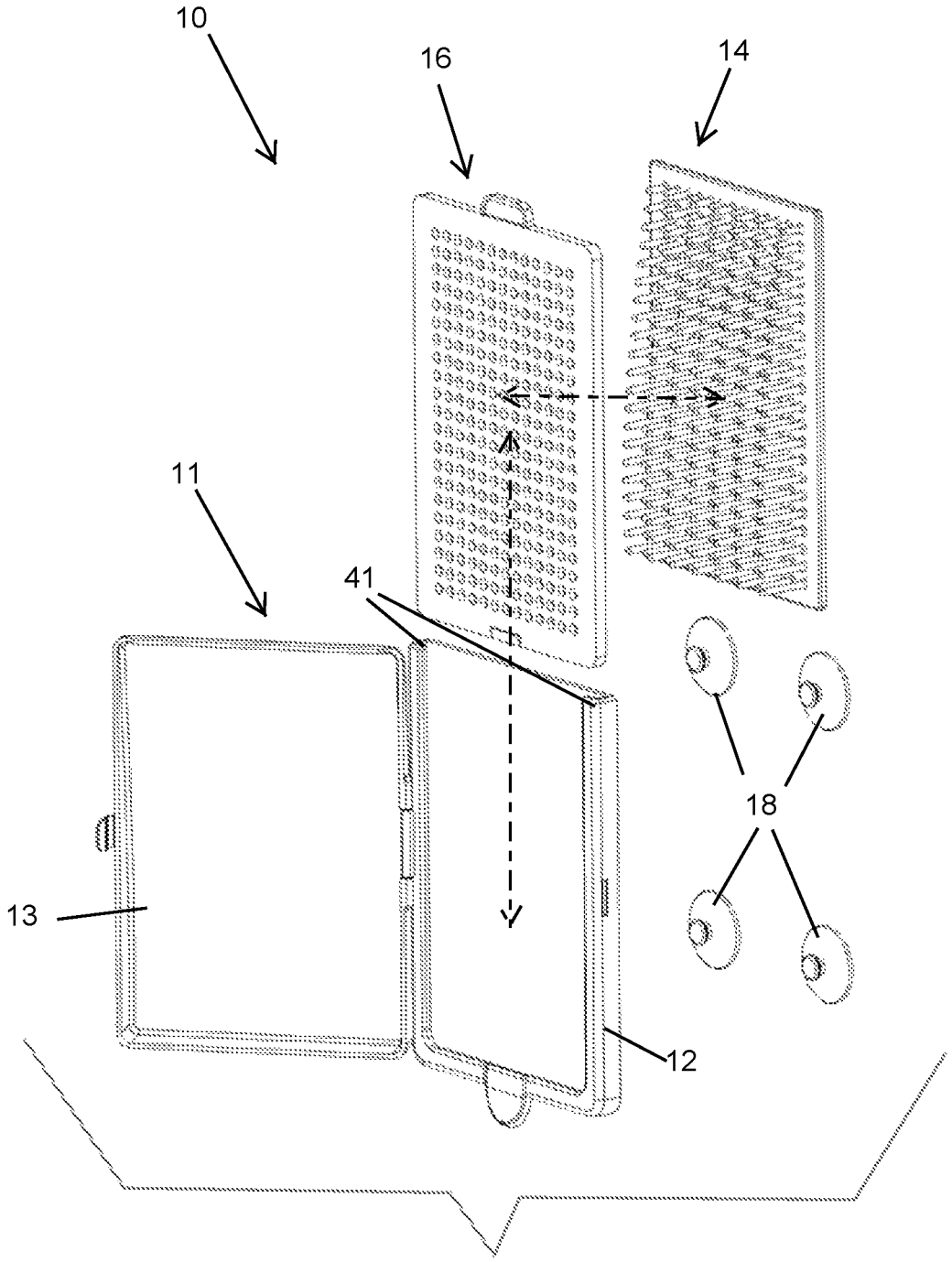
Figure 10:
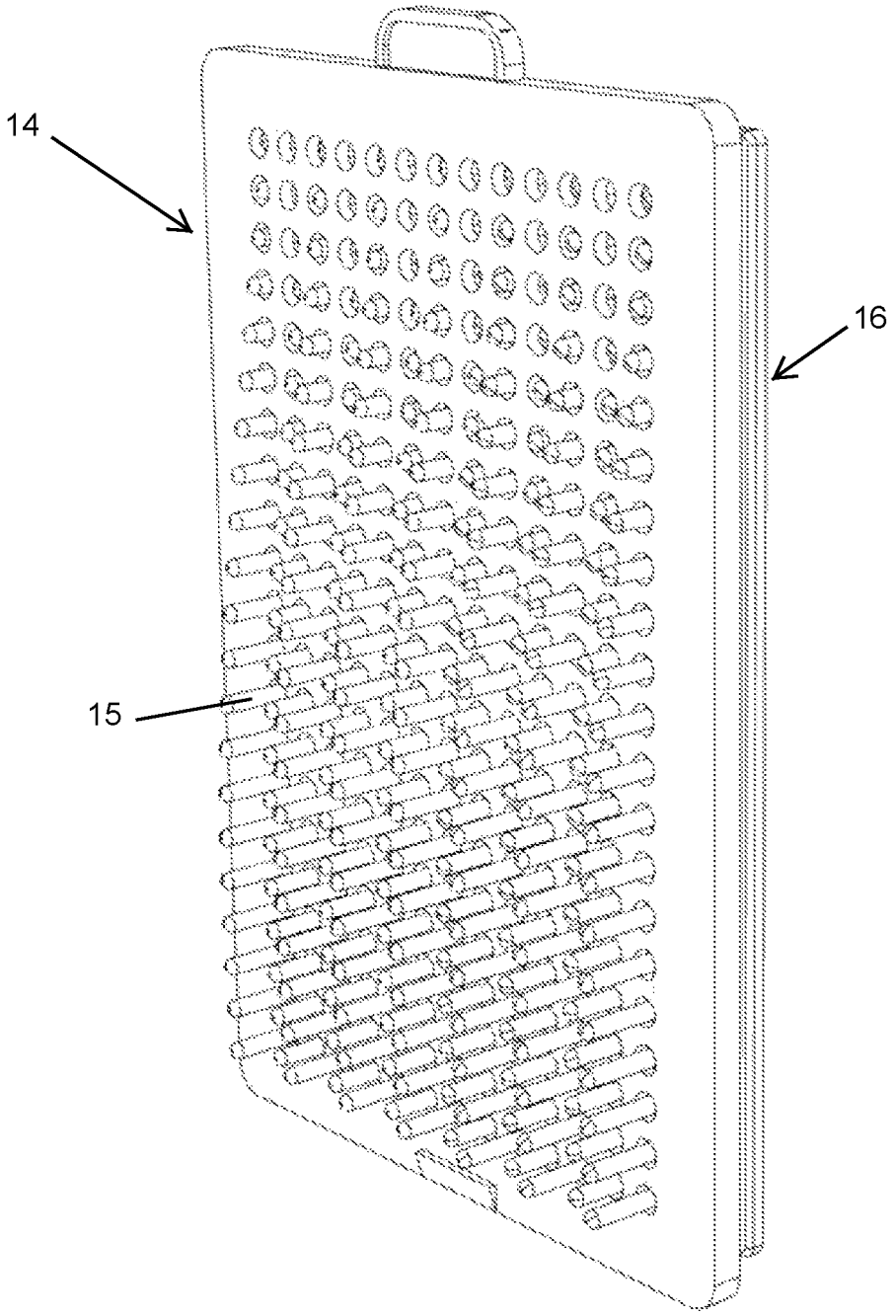
Figure 11:
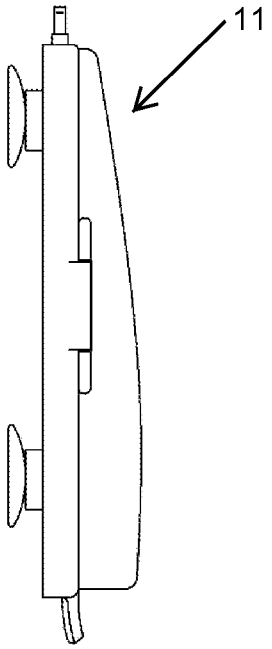
Figure 11A:
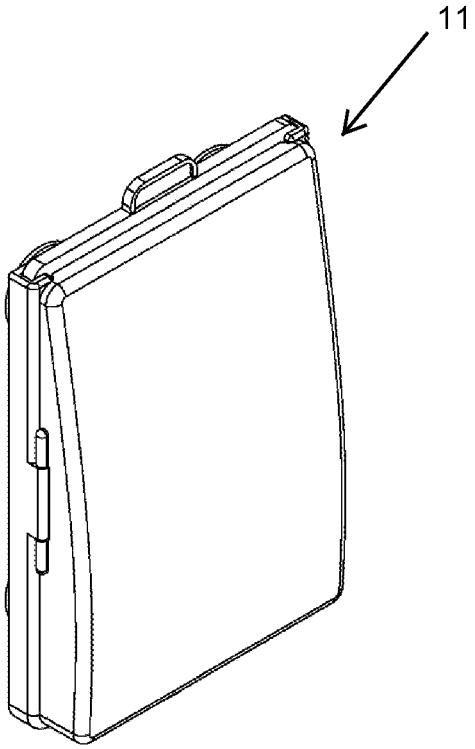
Figure 12:
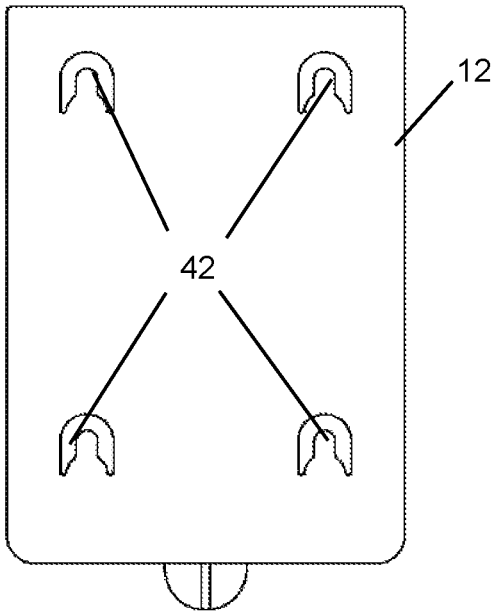
Figure 12A:
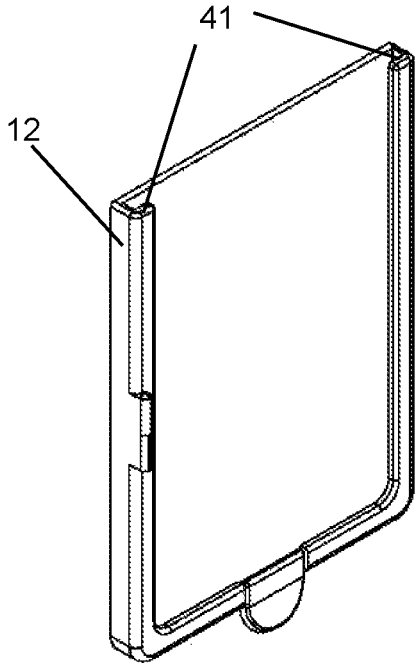
Figure 13:
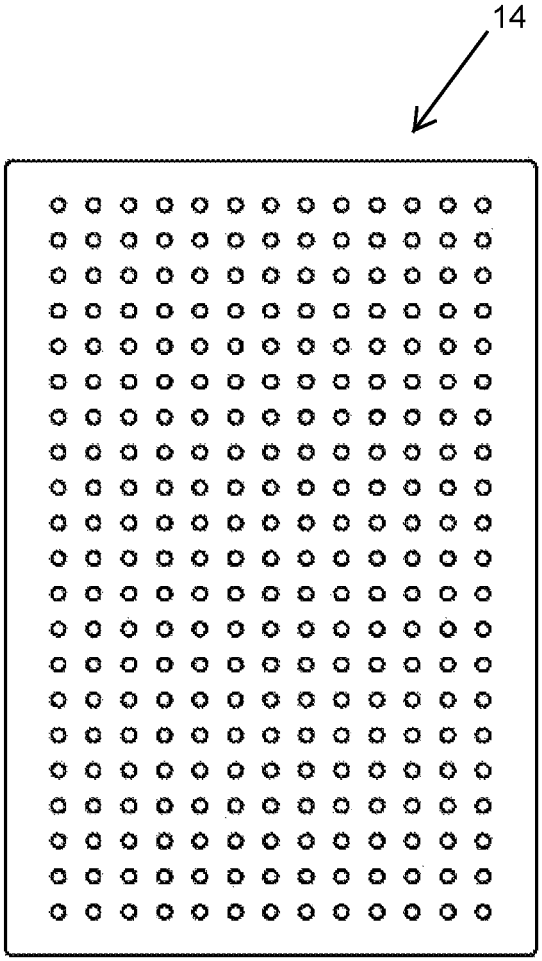
Figure 13A:
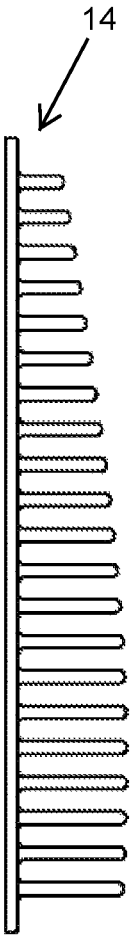
Figure 14:
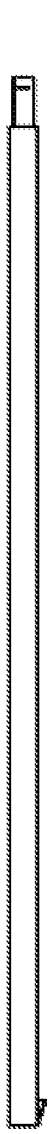

FIG. 9 an exploded view of the hair grooming device shown in FIG. 8;

FIG. 10 is an enlarged perspective view of base plate with bristles engaged with the top plate shown in FIG. 8;

FIG. 11 is a side elevational view of the receptacle shown in FIG. 8;

FIG. 11*a* is a perspective view of the receptacle shown in FIG. 11;

FIG. 12 is a rear elevational view of a portion of the receptacle shown in FIG. 9;

FIG. 12*a* is a perspective view of the portion of the receptacle shown in FIG. 12;

FIG. 13 is rear elevational view of the base plate shown in FIG. 9;

FIG. 13*a* is a perspective view of the base plate shown in FIG. 13;

FIG. 14 is side elevational view of the top plate shown in FIG. 9; and

Figure 14A:
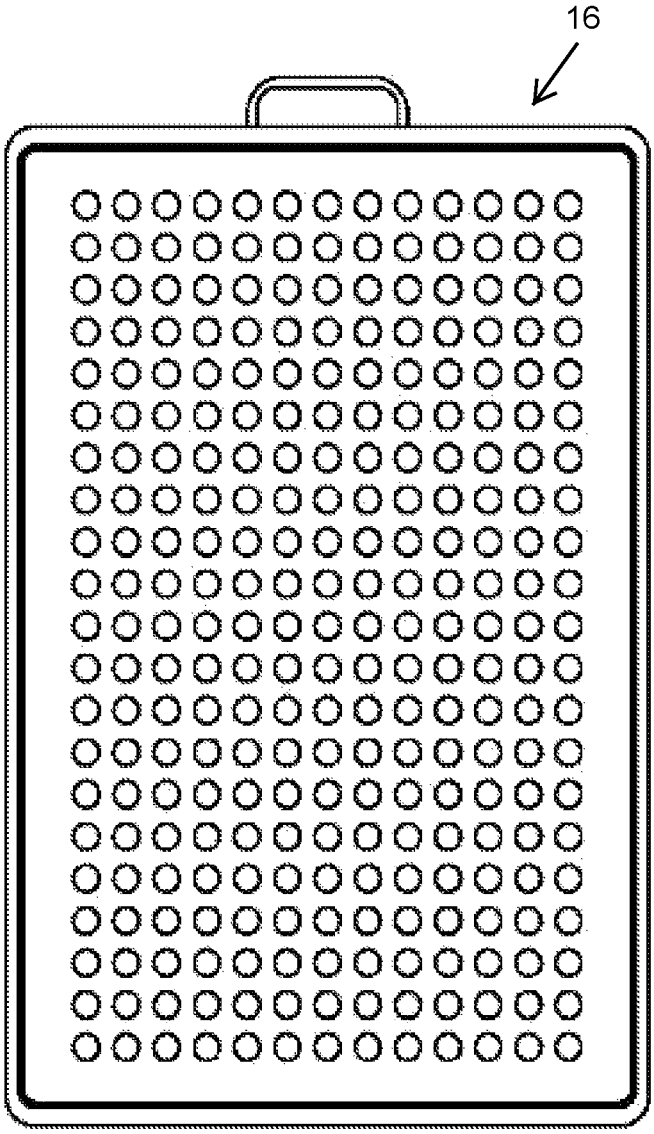

FIG. 14*a* is top plan view of the top plate shown in FIG. 14.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

A non-limiting exemplary embodiment(s) of the present disclosure is referred to generally in FIGS. 1-14*a* and is intended to provide a specially designed hair grooming device 10 including a receptacle 11 for collecting, concealing, and storing hair that is left on one's hands after shampooing, until the user is ready to empty, thus avoiding messes in the bath, messes on the shower walls, and preventing the clogging of drains. It should be understood that the exemplary embodiment(s) may be used to groom a variety of hair species, and should not be limited to any particular hair species described herein.

The non-limiting exemplary embodiment(s) is/are referred to generally in FIGS. 1-14*a* and is/are intended to provide a hair grooming device 10 for collecting, concealing, and storing hair that is left on a user hand after shampooing, until the user is ready to empty, thus avoiding messes in the bath, messes on the shower walls, and preventing the clogging of drains. The hair grooming device 10 includes a receptacle 11 including a first half 12 hingedly coupled to the second half 13, a base plate 14 statically seated within the receptacle 11 and including a plurality of bristles 15 attached thereto, a top plate 16 removably stacked on the base plate 14 and seated in the receptacle 11, the top plate 16 including a plurality of apertures 17, and a plurality of suction cups 18 coupled to the first half 12 of the receptacle 11. Advantageously, the bristles 15 are aligned and positioned through the apertures 17 when the top plate 16 is positioned on the base plate 14 14. In this manner, the bristles 15 terminate away from the top plate 16 such that the top plate 16 shields the base plate 14 from the hair. Notably, the top plate 16 is freely disengaged from the base plate 14 and capable of both collecting and removing the hair from the receptacle 11.

In a non-limiting exemplary embodiment, the base plate 14 has a planar top surface 14*a* and a planar bottom surface 14*b* wherein the top plate 16 has a planar top surface 16*a* and a planar bottom surface 16*b*.

In a non-limiting exemplary embodiment, the bristles 15 include a first group 15*a* of tall bristles 15 and a second group 15*b* of short bristles 15 juxtaposed thereto.

In a non-limiting exemplary embodiment, the first group 15*a* of tall bristles 15 and the second group 15*b* of short bristles 15 are penetrated through the apertures 17, respectively, while the top plate 16 is stacked on the base plate 14.

In a non-limiting exemplary embodiment, the top plate 16 includes a proximal end 16*c* having a flexible pull tab 20 attached thereto.

In a non-limiting exemplary embodiment, the receptacle 11 includes a handle 21 extended along a latitudinal width 22 of the first half 12 of the receptacle 11.

In a non-limiting exemplary embodiment, the top plate 16 is configured to be selectively removed from the first half 12 of the receptacle 11 when disengaged from the base plate 14.

In a non-limiting exemplary embodiment, the planar bottom surface 16*a* of the top plate 16 is registered parallel to the planar top surface 14*a* of the base plate 14 when stacked thereon.

In a non-limiting exemplary embodiment, the first group 15*a* of tall bristles 15 and the second group 15*b* of short bristles 15 are oriented perpendicular to the planar top surface 14*a* of the base plate 14 and the planar top surface 16*a* of the top plate 16.

The present disclosure further includes a method of utilizing a hair grooming device 10 for collecting, concealing, and storing hair that is left on a user hand after shampooing, until the user is ready to empty, thus avoiding messes in the bath, messes on the shower walls, and preventing the clogging of drains. Such a method including the steps of: providing a receptacle 11 including a first half 12 hingedly coupled to the second half 13; providing a base plate 14 including a plurality of bristles 15 attached thereto; statically seating the base plate 14 within the receptacle 11; providing a top plate 16 including a plurality of apertures 17; removably stacking the top plate 16 on the base plate 14 such that the top plate 16 is seated in the receptacle 11; providing and coupling a plurality of suction cups 18 to the first half 12 of the receptacle 11; aligning and positioning the bristles 15 through the apertures 17 by positioning the top plate 16 on the base plate 14; and the bristles 15 terminating away from the top plate 16 such that the top plate 16 shields the base plate 14 from the hair.

The method further includes the steps of: providing shampoo 30; washing a user hair with the shampoo 30; brushing the user hair with the bristles 15 and thereby collecting the user hair on the top plate 16 away from the base plate 14; and freely disengaging the top plate 16 from the base plate 14 and thereby removing the user hair from the receptacle 11.

Referring to FIGS. 1-14*a* in general, in a non-limiting exemplary embodiment(s), the hair grooming device 10 is fashioned of a durable plastic material and measuring approximately seven to eight inches (7"-8") in length, five to six inches (5"-6") in width 22, and two inches (2") in depth. To facilitate attachment to a shower wall, the hair grooming device 10 comes with a series of suction cups 18 that fit onto the unit's back panel. Inside the receptacle 11, a brush with numerous hard but moveable bristles 15 is provided for both collecting the loose hair and removing it from the box. The top plate 16 is freely disengaged from the base plate 14 and capable of both collecting and removing the hair from the receptacle 11. As an additional consideration, the hair grooming device 10 is made available in a variety of colors to appeal to individual tastes or to match any bathroom's decor.

As perhaps best shown in FIGS. 9 and 12*a*, the receptacle 11 has a recessed shoulder 41 along at least two opposed longitudinal sides thereof. Such recessed shoulders 41 allow both the base plate 14 and the top plate 16 to simultaneously slide into and out from the receptacle 11 as needed by the user. Thus, the base plate 14 and top plate 16 are simultaneously, slidably, adjustably, and removably seated with the shoulders 41 of the receptacle 11. Advantageously, base plate 14 and top plate 16 are configured to be simultaneously removed from the receptacle 11. A plurality of brackets 42 are positioned on a back side of the receptacle 11 for supporting the receptacle 11 on a support surface via suction cups 18 or other fasteners, for example.

There are several significant benefits and advantages associated with the hair grooming device 10. Foremost, this clever device 10 allows users to attend to a necessary personal grooming ritual both neatly and quickly. Able to expediently deposit loose hair while shampooing, users certainly appreciate that they are able to rid the hands of the messy, wet detritus. With the hair grooming device 10, consumers can confidently attend to their shampooing regimen without fear of clogged drains and hair residue marring shower and vanity surfaces. Ideal for both men and women for use in the home, the hair grooming device 10 is especially appreciated by styling professionals, kept by shampoo bowls to ensure that stations remain pristine and hair-free. In addition, public venues that offer shower facilities such as gyms and day spas are able to keep their areas clean and drains free of expensive clogs. Compact and lightweight, the hair grooming device 10 is easily packed into a carry-on or personal grooming kit for use while on vacation or traveling for business.

An innovative product, the hair grooming device 10 offers a much-needed accessory for bathing needs. Able to complete the shampooing regimen in a more sanitary manner, busy individuals find this product an essential tool for their personal hygiene endeavors. Affordably priced, the hair grooming device 10 will be well-received by the general consumer populace, an extremely sizable market potential.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A hair grooming device for collecting, concealing, and storing hair that is left on a user hand after shampooing, until the user is ready to empty, thus avoiding messes in the bath, messes on the shower walls, and preventing the clogging of drains, said hair grooming device comprising:

a receptacle including a first half coupled to a second half;

a base plate adjustably seated at said receptacle and including a plurality of bristles attached thereto; and a top plate positioned on said base plate, said top plate including a plurality of apertures;

wherein said bristles are aligned and positioned through said apertures when said top plate is positioned on said base plate;

wherein said top plate shields said base plate from the hair;

wherein said top plate is disengaged from said base plate and configured to both collect and remove the hair from said bristles.

2. The hair grooming device of claim 1, wherein said base plate has a planar top surface and a planar bottom surface, wherein said top plate has a planar top surface and a planar bottom surface.

3. The hair grooming device of claim 2, wherein said bristles comprise: a first group of tall bristles and a second group of short bristles juxtaposed thereto.

4. The hair grooming device of claim 3, wherein said first group of tall bristles and said second group of short bristles are penetrated through said apertures, respectively, while said top plate is stacked on said base plate.

5. The hair grooming device of claim 4, wherein said top plate includes a proximal end having a flexible pull tab attached thereto.

6. The hair grooming device of claim 5, wherein said receptacle comprises: a handle extended along a latitudinal width of said first half of said receptacle.

7. The hair grooming device of claim 6, wherein said top plate is configured to be selectively removed from said first half of said receptacle when disengaged from said base plate.

8. The hair grooming device of claim 7, wherein said bottom surface of said top plate is registered parallel to said top surface of said base plate when stacked thereon.

9. The hair grooming device of claim 8, wherein said first group of tall bristles and said second group of short bristles are oriented perpendicular to said top surface of said base plate and said top surface of said top plate.

10. A hair grooming device for collecting, concealing, and storing hair that is left on a user hand after shampooing, until the user is ready to empty, thus avoiding messes in the bath, messes on the shower walls, and preventing the clogging of drains, said hair grooming device comprising:

a receptacle including a first half coupled to a second half;

a base plate slidably and removably seated at said receptacle and including a plurality of bristles attached thereto;

a top plate stacked on said base plate and located at said receptacle, said top plate including a plurality of apertures; and a plurality of fasteners coupled to said first half of said receptacle;

wherein said bristles are aligned and positioned through said apertures when said top plate is positioned on said base plate;

wherein said bristles terminate away from said top plate such that said top plate shields said base plate from the hair;

wherein said top plate is disengaged from said base plate;

wherein said base plate and said top plate are configured to be simultaneously removed from said receptacle.

11. The hair grooming device of claim 10, wherein said base plate has a planar top surface and a planar bottom surface, wherein said top plate has a planar top surface and a planar bottom surface.

12. The hair grooming device of claim 11, wherein said bristles comprise: a first group of tall bristles and a second group of short bristles juxtaposed thereto.

13. The hair grooming device of claim 12, wherein said first group of tall bristles and said second group of short bristles are penetrated through said apertures, respectively, while said top plate is stacked on said base plate.

14. The hair grooming device of claim 13, wherein said top plate includes a proximal end having a flexible pull tab attached thereto.

15. The hair grooming device of claim 14, wherein said receptacle comprises: a handle extended along a latitudinal width of said first half of said receptacle.

16. The hair grooming device of claim 15, wherein said top plate is configured to be selectively removed from said first half of said receptacle when disengaged from said base plate.

17. The hair grooming device of claim 16, wherein said bottom surface of said top plate is registered parallel to said top surface of said base plate when stacked thereon.

18. The hair grooming device of claim 17, wherein said first group of tall bristles and said second group of short bristles are oriented perpendicular to said top surface of said base plate and said top surface of said top plate.

19. A method of utilizing a hair grooming device for collecting, concealing, and storing hair that is left on a user hand after shampooing, until the user is ready to empty, thus avoiding messes in the bath, messes on the shower walls, and preventing the clogging of drains, said method comprising the steps of:

providing a receptacle including a first half hingedly coupled to a second half;

providing a base plate including a plurality of bristles attached thereto;

adjustably seating said base plate within said receptacle;

providing a top plate including a plurality of apertures;

removably stacking said top plate on said base plate such that said top plate is seated in said receptacle;

providing and coupling a plurality of fasteners to said first half of said receptacle;

aligning and positioning said bristles through said apertures by positioning said top plate on said base plate;

said bristles terminating away from said top plate such that said top plate shields said base plate from the hair;

providing shampoo;

washing a user hair with the shampoo;

brushing the user hair with said bristles and thereby collecting the user hair on said top plate away from said base plate; and freely disengaging said top plate from said base plate and thereby removing the user hair from said receptacle.

* * * * *